United States Patent [19]

Jinba et al.

[11] Patent Number: 4,632,733

[45] Date of Patent: Dec. 30, 1986

[54] METHOD FOR MANUFACTURING ONE-SIDE ELECTROGALVANIZED STEEL STRIP

[75] Inventors: Terumasa Jinba; Shiro Fukunaka; Tatsuro Anan; Nobuo Shiotani, all of Fukuyama, Japan

[73] Assignee: Nippon Kokan Kabushiki Kaisha, Tokyo, Japan

[21] Appl. No.: 814,615

[22] Filed: Dec. 30, 1985

[51] Int. Cl.[4] ..... C25D 7/06

[52] U.S. Cl. ..... 204/28

[58] Field of Search ..... 204/28

[56] References Cited

FOREIGN PATENT DOCUMENTS 5679878 6/1980 Japan ..... 204/28

*Primary Examiner*—T. M. Tufariello

*Attorney, Agent, or Firm*—Frishauf, Holtz, Goodman & Woodward

[57] ABSTRACT

A method for manufacturing a one-side electrogalvanized steel strip, which comprises: continuously causing a steel strip to travel through an electrogalvanizing bath in an electrogalvanizing tank; arranging an electrode plate in the electrogalvanizing bath in the electrogalvanizing tank in parallel to a one-side surface to be electrogalvanized of the steel strip; electrogalvanizing the one-side surface of the steel strip; arranging a spray nozzle toward the other surface not electrogalvanized of the steel strip which has passed through the electrogalvanizing tank; ejecting any one of an aqueous solution containing a weak acid of from 0.1 to 5.0 wt. % and a saturated monovalent alcohol having carbon atoms of up to 5 from the spray nozzle onto the other surface of the steel strip to wet the other surface of the steel strip; arranging a brush roll in close proximity to the spray nozzle on the same side as the spray nozzle; and rotating the brush roll while bringing same into contact with the other surface thus wet of the steel strip to eliminate contamination caused by the deposition of an electrogalvanizing solution on the other surface of the steel strip.

2 Claims, 1 Drawing Figure

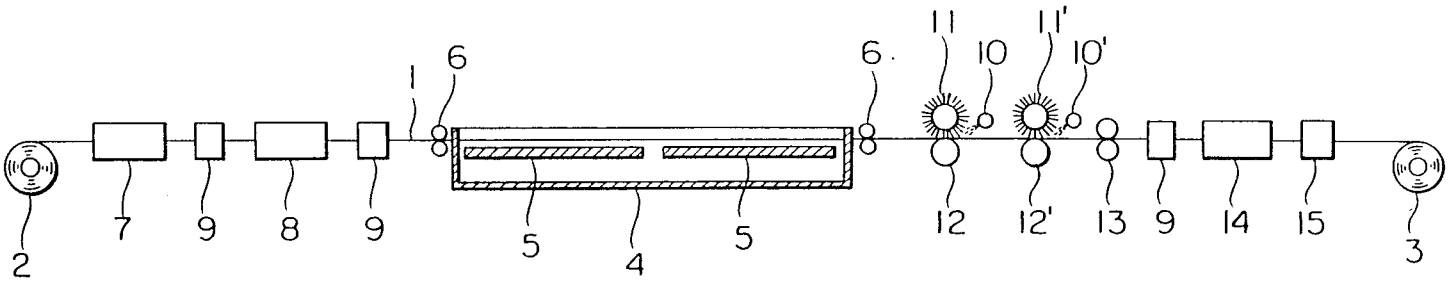
2
7
9
8
9
1
6
5
4
5
6
11
10
12
11'
10'
12'
13
9
14
15
3

METHOD FOR MANUFACTURING ONE-SIDE ELECTROGALVANIZED STEEL STRIP

REFERENCE TO PATENTS, APPLICATIONS AND PUBLICATIONS PERTINENT TO THE INVENTION

As far as we know, the prior art document pertinent to the present invention is:

Japanese Patent Provisional Publication No. 55-79,878 dated June 16, 1980.

The contents of the prior art disclosed in the above-mentioned prior art document will be discussed under the heading of the "BACKGROUND OF THE INVENTION" hereafter.

FIELD OF THE INVENTION

The present invention relates to a method for manufacturing a one-side electrogalvanized steel strip by electrogalvanizing only the one-side surface of the steel strip.

BACKGROUND OF THE INVENTION

There is a strong demand from automobile manufacturers and other users for a one-side electrogalvanized steel strip of which the other surface not electrogalvanized is beautiful in external appearance, excellent in corrosion resistance after painting, and free from painting irregularities and defective adherence of paint.

A one-side electrogalvanized steel strip is conventionally manufactured as follows: continuously causing a steel strip to travel through an electrogalvanizing bath in an electrogalvanizing tank; arranging at least one electrode plate in the electrogalvanizing bath in the electrogalvanizing tank in parallel to a one-side surface to be electrogalvanized of the travelling steel strip; and causing an electric current to flow between the at least one electrode plate and the travelling steel strip through the electrogalvanizing bath to electrogalvanize the one-side surface of the travelling steel strip.

However, the above-mentioned conventional manufacturing method has a problem in that yellowish contamination is produced on the other surface not electrogalvanized of the steel strip which has passed through the electrogalvanizing bath in the electrogalvanizing tank. A main cause of the production of such yellowish contamination is that the other surface not galvanized of the steel strip which has passed through the electrogalvanizing tank is oxidized by an electrogalvanizing solution deposited on the other surface. Particularly, the above-mentioned contamination on the other surface not electrogalvanized of the steel strip becomes more serious when the one-side electrogalvanized steel strip is heated to alloy an electrogalvanized layer formed on the one-side surface of the steel strip into an iron-zinc alloy layer.

The presence of the above-mentioned contamination on the other surface not electrogalvanized of the steel strip causes the following problems:

(1) The other surface not electrogalvanized of the steel strip loses the gloss thereof, and thus the external appearance of the other surface worsens.

(2) When a phosphate treatment is applied to the other surface not electrogalvanized of the steel strip, a phosphate film having dense crystals cannot be formed on the other side.

(3) When painting is applied onto the phosphate film formed on the other surface not electrogalvanized of the steel strip, the other surface shows a degraded corrosion resistance after painting, and painting irregularities and defective adherence of paint are caused.

As a method for solving the above-mentioned problems, a method for manufacturing a one-side electrogalvanized steel strip is disclosed in Japanese Patent Provisional Publication No. 55-79,878 dated June 16, 1980, which comprises:

continuously causing a steel strip to travel through an electrogalvanizing bath in an electrogalvanizing tank; arranging at least one electrode plate in said electrogalvanizing bath in said electrogalvanizing tank in parallel to a one-side surface to be electrogalvanized of said travelling steel strip; causing an electric current to flow between said at least one electrode plate and said travelling steel strip through said electrogalvanizing bath to electrogalvanize said one-side surface of said travelling steel strip; arranging at least one spray nozzle toward the other surface not electrogalvanized of said travelling steel strip which has passed through said galvanizing tank; ejecting water from said at least one spray nozzle onto said other surface of said travelling steel strip to wet said other surface of said travelling steel strip; arranging at least one brush roll in contact with said other surface not electrogalvanized of said travelling steel strip; and rotating said at least one brush roll to eliminate contamination caused by the deposition of an electrogalvanizing solution on said other surface of said travelling steel strip (hereinafter referred to as the "prior art").

However, the above-mentioned prior art has the following problems:

(1) Elimination of contamination produced on the other surface not electrogalvanized of the one-side electrogalvanized steel strip is insufficient. Therefore, the external appearance of the other surface cannot be made sufficiently beautiful. In addition, when applying a phosphate treatment to the other surface not electrogalvanized of the steel strip, crystals of a phosphate film formed on the other surface cannot be made sufficiently dense. Furthermore, when applying painting onto the phosphate film formed on the other surface not galvanized of the steel strip, corrosion resistance after painting of the other surface is insufficient, and painting irregularities and defective paint adherence cannot be prevented from occurring on the other surface.

(2) Contamination produced on the other surface not galvanized of the travelling steel strip cannot be sufficiently eliminated unless the rotating brush roll is strongly pushed to the other surface. This leads to a serious wear of the brush roll.

Under such circumstances, there is a strong demand for the development of a method for manufacturing a one-side electrogalvanized steel strip, which permits sufficient elimination of contamination produced on the other surface not electrogalvanized of the one-side electrogalvanized steel strip, permits formation of a phosphate film having dense crystals on the other surface not electrogalvanized when applying a phosphate treatment to the other surface, and when applying painting onto the phosphate film formed on the other surface not galvanized, permits impartment of a high corrosion resistance after painting to the other surface and prevention of painting irregularities and defective paint adherence from occurring on the other surface, but such a method has not as yet been proposed.

SUMMARY OF THE INVENTION

A principal object of the present invention is therefore to provide a method for manufacturing a one-side electrogalvanized steel strip, which permits sufficient elimination of contamination produced on the other surface not electrogalvanized of the one-side electrogalvanized steel strip.

Another object of the present invention is to provide a method for manufacturing a one-side electrogalvanized steel strip, which permits formation of a phosphate film having dense crystals on the other surface not electrogalvanized of the one-side electrogalvanized steel strip when applying a phosphate treatment to the other surface.

Still another object of the present invention is to provide a method for manufacturing a one-side electrogalvanized steel strip, which permits, when applying painting onto the phosphate film formed on the other surface not electrogalvanized of the one-side electrogalvanized steel strip, impartment of a high corrosion resistance after painting to the other surface and prevention of painting irregularities and defective paint adherence from occurring on the other surface.

In accordance with one of the features of the present invention, there is provided a method for manufacturing a one-side electrogalvanized steel strip, which comprises:

continuously causing a steel strip to travel through an electrogalvanizing bath in an electrogalvanizing tank; arranging at least one electrode plate in said electrogalvanizing bath in said electrogalvanizing tank in parallel to a one-side surface to be electrogalvanized of said travelling steel strip; causing an electric current to flow between said at least one electrode plate and said travelling steel strip through said electrogalvanizing bath to electrogalvanize said one-side surface of said travelling steel strip; arranging at least one spray nozzle toward the other surface not electrogalvanized of said travelling steel strip which has passed through said electrogalvanizing tank over the entire width of said steel strip; ejecting liquid from said at least one spray nozzle onto said other surface not electrogalvanized of said travelling steel strip to wet said other surface of said travelling steel strip; arranging at least one brush roll in close proximity to said at least one spray nozzle on the same side as said at least one spray nozzle relative to said travelling steel strip, said at least one brush roll having a rotation axis parallel to the width direction of said travelling steel strip and extending over the entire width of said steel strip, said at least one brush roll being in contact with said other surface not electrogalvanized of said travelling steel strip; and rotating said at least one brush roll to eliminate contamination caused by the deposition of an electrogalvanizing solution on said other surface not electrogalvanized of said travelling steel strip;

characterized in that:

said liquid to be ejected from said at least one spray nozzle is any one of an aqueous solution containing a weak acid within the range of from 0.1 to 5.0 wt. % and a saturated monovalent alcohol solution having a number of carbon atoms of up to 5.

BRIEF DESCRIPTION OF THE DRAWING

The attached drawing is a schematic diagram illustrating an embodiment of the method of the present invention.

DETAILED DESCRIPTION OF PREFERRED EMBODIMENT

From the above-mentioned point of view, extensive studies were carried out to develop a method for manufacturing a one-side electrogalvanized steel strip, which permits sufficient elimination of contamination produced on the other surface not electrogalvanized of the one-side electrogalvanized steel strip, permits formation of a phosphate film having dense crystals on the other surface not electrogalvanized when applying a phosphate treatment to the other surface, and when applying painting onto the phosphate film formed on the other surface not electrogalvanized, permits impartment of a high corrosion resistance after painting to the other surface and prevention of painting irregularities and defective paint adherence from occurring on the other surface.

As a result, the following finding was obtained. It is possible to sufficiently eliminate contamination caused by the deposition of an electrogalvanizing solution on the other surface not electrogalvanized of the travelling steel strip, by arranging at least one spray nozzle toward the other surface not electrogalvanized of the travelling steel strip which has passed through the electrogalvanizing tank; ejecting any one of an aqueous solution containing a weak acid within the range of from 0.1 to 5.0 wt. % and a saturated monovalent alcohol solution having a number of carbon atoms of up to 5, from the at least one spray nozzle onto the other surface not electrogalvanized of the travelling steel strip, to wet the other surface of the travelling steel strip; and rotating at least one brush roll which is arranged in contact with the other surface not electrogalvanized of the travelling steel strip.

The present invention was made on the basis of the above-mentioned finding. In the present invention, a liquid to be ejected from the at least one spray nozzle onto the other surface not electrogalvanized of the travelling steel strip which has passed through the electrogalvanizing tank to wet the other surface of the travelling steel strip is limited to any one of an aqueous solution containing a weak acid within the range of from 0.1 to 5.0 wt. % and a saturated monovalent alcohol solution having a number of carbon atoms of up to 5.

The reasons why the liquid to be ejected onto the other surface not electrogalvanized of the travelling steel strip is limited as above are described below.

(1) Aqueous solution containing a weak acid within the range of from 0.1 to 5.0 wt. %:

Ejection of an aqueous solution containing a weak acid within the range of from 0.1 to 5.0 wt. % onto the other surface not electrogalvanized of the travelling steel strip which has passed through the electrogalvanizing tank to wet the other surface, makes it easy to eliminate contamination produced on the other surface under the effect of the weak acid. It is thus possible to sufficiently eliminate contamination produced on the other surface by means of the at least one brush roll. With a weak acid content in the aqueous solution of under 0.1 wt. %, a desired effect as mentioned above cannot be obtained. With a weak acid content in the aqueous solution of over 5.0 wt. %, on the other hand, the other surface not electrogalvanized of the travelling steel strip is oxidized and contamination is produced on the other surface. The weak acid may be any one of oxalic acid, citric acid, malonic acid and acetic acid. If an aqueous solution containing a strong acid such as hydrochloric acid or sulfuric acid is ejected, the other surface not electrogalvanized of the travelling steel strip is oxidized and contamination is produced on the other surface.

(2) Saturated monovalent alcohol solution having a number of carbon atoms of up to 5:

When a saturated monovalent alcohol solution having a number of carbon atoms of up to 5 is ejected onto the other surface not electrogalvanized of the travelling steel strip to wet the other surface, an electrogalvanizing solution deposited onto the other surface evaporates together with the alcohol solution. It is therefore possible to sufficiently eliminate contamination produced on the other surface by means of the at least one brush roll. If a saturated monovalent alcohol solution having a number of carbon atoms of over 5 is ejected, part of carbon in the alcohol solution remains on the other surface not electrogalvanized of the travelling steel strip. As a result, when heating the one-side electrogalvanized steel strip to alloy the electrogalvanized layer formed on the one-side surface of the steel strip into an iron-zinc alloy layer, black contamination is produced on the other surface not electrogalvanized under the effect of the above-mentioned remaining carbon. If a polyhydric alcohol solution, which is viscous, is ejected, the alcohol solution remains on the other surface not electrogalvanized of the travelling steel strip. As a result, black contamination is also produced when applying the above-mentioned alloying treatment of the electrogalvanized layer as in the case mentioned above.

Now, the method of the present invention is described with reference to the attached drawing. The attached drawing is a schematic diagram illustrating an embodiment of the method of the present invention. As shown in the drawing, a steel strip 1, which runs from an uncoiler 2 to a coiler 3, is caused to travel continuously and substantially horizontally through an electrogalvanizing bath in a horizontal type electrogalvanizing tank 4 which is arranged between the uncoiler 2 and the coiler 3. Two horizontal electrode plates 5 are arranged in the electrogalvanizing bath in the electrogalvanizing tank 4 in parallel with the lower surface to be electrogalvanized of the steel strip 1 travelling through the electrogalvanizing bath in the electrogalvanizing tank 4. A pair of conductor rollers 6 for supplying an electric current to the travelling steel strip 1, is provided respectively at the steel strip entry side and at the steel strip exit side of the electrogalvanizing tank 4. An electric current is caused to flow between the electrode plates 5 and the travelling steel strip 1 to electrogalvanize the lower surface of the travelling steel strip 1.

A degreasing tank 7 for removing oil deposited onto the surfaces of the travelling steel strip 1 and a pickling tank 8 for removing dirt deposited on the surfaces of the travelling steel strip 1 are arranged in this order between the uncoiler 2 and the electrogalvanizing tank 4. Water-rinsing tanks 9 for water-rinsing the surfaces of the steel strip 1, are arranged respectively between the degreasing tank 7 and the pickling tank 8 and between the pickling tank 8 and the electrogalvanizing tank 4.

A first spray nozzle 10 and a second spray nozzle 10' are arranged toward the upper surface not electrogalvanized of the travelling steel strip 1 which has passed through the electrogalvanizing tank 4, at a prescribed distance between the electrogalvanizing tank 4 and the coiler 3, over the entire width of the travelling steel strip 1. Any one of an aqueous solution containing a weak acid within the range of from 0.1 to 5.0 wt. % and a saturated monovalent alcohol solution having a number of carbon atoms of up to 5 is ejected from the first and second spray nozzles 10, 10' onto the upper surface not electrogalvanized of the travelling steel strip 1 to wet the upper surface thereof.

A first brush roll 11 and a second brush roll 11' are arranged in close proximity respectively to the first and second spray nozzles 10, 10' on the same side as the first and second spray nozzles 10, 10' relative to the travelling steel strip 1. Each of the first and second brush rolls 11, 11' has a rotation axis parallel to the width direction of the travelling steel strip 1 and extends over the entire width of the steel strip 1. A first backup roll 12 and a second backup roll 12' are arranged respectively under the first and second brush rolls 11, 11', with the travelling steel strip 1 therebetween, so as to come into contact with the lower surface of the steel strip 1. Each of the first and second backup rolls 12, 12' has, just as each of the first and second brush rolls 11, 11', a rotation axis parallel to the width direction of the travelling steel strip 1 and extends over the entire width of the steel strip 1.

The first and second brush rolls 11, 11' are vertically movable and in contact with the upper surface not electrogalvanized of the travelling steel strip 1 so as to push the tips of the first and second brush rolls 11, 11' to the upper surface not electrogalvanized of the travelling steel strip 1. Contamination caused by the deposition of an electrogalvanizing solution on the upper surface not electrogalvanized of the travelling steel strip 1 is sufficiently eliminated by rotating the first and second brush rolls 11, 11'.

Between the second brush roll 11' and the coiler 3, a pair of squeezing rolls 13 for squeezing out the solution deposited onto the surfaces of the travelling steel strip 1, a water-rinsing tank 9 for water-rinsing the surfaces of the steel strip 1, a dryer 14 for drying the surfaces of the steel strip 1, and an oil applicator 15 for applying an anticorrosive oil onto the surfaces of the steel strip 1 are arranged in this order.

According to the method of the present invention, the one-side electrogalvanized steel strip is continuously manufactured as follows. The lower surface of the travelling steel strip 1 is electrogalvanized in the electrogalvanizing tank 4 while passing therethrough. The upper surface not electrogalvanized of the travelling steel strip 1 which has passed through the electrogalvanizing tank 4 is wetted by any one of the aqueous solution containing a weak acid within the range of from 0.1 to 5.0 wt. % and the saturated monovalent alcohol solution having a number of carbon atoms of up to 5 ejected from the first and second spray nozzles 10, 10'. Contamination produced on the upper surface not electrogalvanized of the travelling steel strip 1 is sufficiently eliminated by the rotation of the first and second brush rolls 11, 11'. From the travelling steel strip 1 from which the contamination has thus been eliminated, a solution deposited onto the surfaces thereof is squeezed by the pair of squeezing rolls 13, and then, the travelling steel strip 1 is water-rinsed in the water-rinsing tank 9, dried in the dryer 14, applied with the anticorrosive oil in the oil applicator 15, and finally coiled by the coiler 3.

Now, the method of the present invention is described further in detail by means of an example while comparing with comparative cases.

EXAMPLE

The lower surface of a steel strip 1 was electrogalvanized in the horizontal type electrogalvanizing tank 4 in accordance with the process as illustrated in the drawing, under the following conditions:

(1) Dimensions of the steel strip:
thickness: 0.8 mm,
width: 1,250 mm,
(2) travelling speed of the steel strip: 30 m/minute,
(3) Chemical composition of the electrogalvanizing bath used: zinc sulfate ($ZnSO_4.7H_2O$): 300 g/l
(4) Electrogalvanizing conditions:
pH of the electrogalvanizing bath: from 3 to 4,
temperature of the electrogalvanizing bath: from 50° to 60° C.,
electrogalvanizing current density: 70 A/dm$^2$,
target weight of electrogalvanized layer: 40 g/m$^2$.

Then, as shown in Tables 1 and 2, an aqueous solution containing a weak acid within the range of from 0.1 to 5.0 wt. % or a saturated monovalent alcohol solution having a number of carbon atoms of up to 5 was ejected from the first spray nozzle 10, or from both the first and second spray nozzles 10, 10' onto the upper surface not electrogalvanized of the travelling steel strip 1 which had passed through the electrogalvanizing tank 4, to wet the upper surface not electrogalvanized of the travelling steel strip 1. Subsequently, the first brush roll 11 or both the first and second brush rolls 11, 11' were brought into contact with the upper surface not electrogalvanized of the travelling steel strip 1 and rotated to eliminate contamination caused by the deposition of an electrogalvanizing solution on the upper surface of the steel strip 1, and thus to prepare samples Nos. 1 to 9 of the one-side electrogalvanized steel strip of the present invention (hereinafter referred to as the "sample of the present invention") as shown in Table 1. A roll having a nylon brush coated with fine particles of grit was used for each of the first and second brush rolls 11, 11'. The first and second brush rolls 11, 11' were rotated at a rate of from 1,000 to 1,200 revolutions per minute in the direction opposite to the travelling direction of the steel strip 1.

For comparison purposes, samples Nos. 1 to 11 (hereinafter referred to the "comparison sample") as also shown in Tables 1 and 2 were prepared from the one-side electrogalvanized steel strip, of which contamination produced on the upper surface not electrogalvanized of the steel strip was not eliminated or was eliminated by a method outside the scope of the present invention. The comparison sample No. 1 represents a case where liquid 10, 10', and the first and second brush rolls 11, 11' were not used. The comparison sample No. 2 represents a case where water was ejected only from the first spray nozzle 10, and the first and second brush rolls 11, 11' were not used. The comparison samples Nos. 3 and 4 represent a case where the first and second brush rolls 11, 11' were used, but no liquid was ejected from the first and second spray nozzles 10, 10'. The comparison sample No. 5 represents a case where water was ejected from the first and second spray nozzles 10, 10', and the first and second brush rolls 11, 11' were used. The comparison sample No. 6 represents a case where water was ejected only from the first spray nozzle 10, and only the first brush roll 11 was used. The comparison sample No. 7 represents a case where an aqueous solution containing acetic acid in an amount outside the range specified in the present invention was ejected from the first and second spray nozzles 10, 10', and the first and second brush rolls 11, 11' were used. The comparison sample No. 8 represents a case where an aqueous solution containing acetic acid in an amount outside the range specified in the present invention was ejected only from the first spray nozzle 10, and only the first brush roll 11 was used. The comparison samples Nos. 9 and 10 represent a case where an aqueous solution containing a strong acid was ejected only from the first spray nozzle 10, and only the first brush roll 11 was used. The comparison sample No. 11 represents a case where a saturated monovalent alcohol solution having a number of carbon atoms outside the range specified in the present invention was ejected only from the first spray nozzle 10, and only the first brush roll 11 was used.

For each of the thus prepared samples of the present invention Nos. 1 to 9 and comparison samples Nos. 1 to 11, gloss of the other surface not electrogalvanized was evaluated with reference to the following criteria. Then, each of the above-mentioned samples was heated at a temperature of 300° C. for three hours to alloy the electrogalvanized layer formed on the one-side surface of the steel strip into an iron-zinc alloy plated layer. For each of the thus alloying-treated samples, gloss of the other surface not electrogalvanized was evaluated with reference also to the following criteria:

: very good surface gloss,
: good surface gloss,
Δ: fair surface gloss,
x: bad surface gloss,
xx: very bad surface gloss.

The results of the above-mentioned evaluations are also shown in Table 1.

TABLE 1

| | | Liquid ejected from spray nozzle | | Push-down distance of brush roll (mm) | | Surface gloss | |
|---|---|---|---|---|---|---|---|
| | | Kind | Acid content (wt. %) | First brush roll | Second brush roll | Alloying not applied | Alloying applied |
| Sample of the present invention | 1 | Aqueous solution of oxalic acid | 3 | 3 | 1 | | |
| | 2 | Aqueous solution of oxalic acid | 3 | 2 | — | | |
| | 3 | Aqueous solution of malonic acid | 4 | 3 | 1 | | |
| | 4 | Aqueous solution of malonic acid | 4 | 2 | — | | |
| | 5 | Aqueous solution of citric acid | 1 | 3 | 1 | | |
| | 6 | Aqueous solution of citric acid | 1 | 2 | — | | |

TABLE 1-continued

| | | Liquid ejected from spray nozzle | | Push-down distance of brush roll (mm) | | Surface gloss | |
|---|---|---|---|---|---|---|---|
| | | Kind | Acid content (wt. %) | First brush roll | Second brush roll | Alloying not applied | Alloying applied |
| | 7 | Aqueous solution of acetic acid | 0.2 | 3 | 1 | | |
| | 8 | Saturated monovalent alcohol solution with carbon atoms of 5 | | 2 | — | | |
| | 9 | Saturated monovalent alcohol solution with carbon atoms of 2 | | 2 | — | | |
| Comparison sample | 1 | — | | — | — | xx | xx |
| | 2 | water | | — | — | x | xx |
| | 3 | — | | 3 | 3 | xx | xx |
| | 4 | — | | 5 | 3 | | Δ |
| | 5 | water | | 3 | 1 | | Δ |
| | 6 | water | | 2 | — | | Δ |
| | 7 | Aqueous solution of acetic acid | 7 | 3 | 1 | | Δ |
| | 8 | Aqueous solution of acetic acid | 7 | 2 | — | | Δ |
| | 9 | Aqueous solution of sulfuric acid | 0.2 | 2 | — | | Δ |
| | 10 | Aqueous solution of hydrochloric acid | 0.1 | 2 | — | | Δ |
| | 11 | Saturated monovalent alcohol solution with carbon atoms of 10 | | 2 | — | | Δ |

The push-down distance of the brush roll as shown in Table 1 indicates a distance, after bringing the tip of the brush of the brush roll 11, 11' into contact with the other surface not electrogalvanized of the steel strip 1, of further pushing down the brush roll 11, 11' from the contact position of the tip thereof toward the other surface.

As is clear from Table 1, in the samples of the present invention Nos. 1 to 9, contamination caused by the deposition of an electrogalvanizing solution on the other surface not electrogalvanized of the steel strip 1 was sufficiently eliminated by the first brush roll 11 or by both the first and second brush rolls 11, 11'. Therefore, the surface gloss of the other surface not electrogalvanized was very good not only in the cases where the alloying treatment of the electrogalvanized layer was not applied, but also in the cases where the alloying treatment was applied, resulting in a beautiful external appearance of the other surface. In these cases, the above-mentioned push-down distance of the brush roll was slight, leading to a limited wear of the brush roll 11, 11'. In the comparison samples Nos. 1 to 3, in contrast, the other surface not electrogalvanized of the steel strip 1 showed a bad surface gloss. In the comparison samples Nos. 4 to 11, the surface gloss of the other surface was low as compared with the samples of the present invention Nos. 1 to 9; particularly in cases with the alloying treatment, the surface gloss of the other surface was bad in all cases.

Then, for each of the samples of the present invention Nos. 1 to 9 and the comparison samples Nos. 1 to 11, the phosphate treatment was applied to the other surface not electrogalvanized of the steel strip 1 with the use of a zinc phosphate treatment solution (BONDERITE NO. 3118) made by Nihon Parkerizing Co., Ltd. to form a zinc phosphate film on the other surface. Subsequently, on the zinc phosphate film formed as described above, electrodeposition painting was applied with the use of a paint (ELECTRON No. 7,200) made by Kansai Paint Co., Ltd. to form a paint film having a thickness of 20 μm on the zinc phosphate film.

For each of the samples of the present invention Nos. 1 to 9 and the comparison samples Nos. 1 to 11, having the zinc phosphate film formed on the other surface not electrogalvanized, the number of crystal nuclei of zinc phosphate per unit area of the zinc phosphate film was counted by means of a scanning electron microscope. Then, for each of the samples of the present invention Nos. 1 to 9 and the comparison samples Nos. 1 to 11, having the paint film formed on the above-mentioned zinc phosphate film, corrosion resistance after painting was investigated. Investigation of corrosion resistance after painting was performed by providing a cruciform slit on the paint film, subjecting the sample thus provided with the cruciform slit to a salt spray test set forth in JIS Z2371, and measuring the maximum rust width on one side of the cruciform slit on the sample after the lapse of 480 hours of the test.

Each of the samples of the present invention Nos. 1 to 9 and the comparison samples Nos. 1 to 11 was heated at a temperature of 300° C. for three hours, to alloy the electrogalvanized layer formed on the one-side surface of the sample into an iron-zinc alloy layer. Then, the zinc phosphate film as described above was formed on the other surface not electrogalvanized of each of the thus alloying-treated samples, and the paint film as described above was formed on the zinc phosphate film. For each of the thus alloying-treated samples, the number of crystal nuclei of zinc phosphate per unit area of the zinc phosphate film and corrosion resistance after painting were investigated.

The values of the number of crystal nuclei of zinc phosphate per unit area of the zinc phosphate film and corrosion resistance after painting as expressed by the maximum rust width are comprehensively shown in Table 2.

TABLE 2

| | | Liquid ejected from spray nozzle | | Push-down distance of brush roll (mm) | | Number of crystal nuclei of zinc phosphate ($\times 10^4/cm^2$) | | Corrosion resistance after painting (mm) | |
|---|---|---|---|---|---|---|---|---|---|
| | | Kind | Acid content (wt. %) | First brush roll | Second brush roll | Alloying not applied | Alloying applied | Alloying not applied | Alloying applied |
| Sample of the present invention | 1 | Aqueous solution of oxalic acid | 3 | 3 | 1 | 96 | 88 | 0.2 | 0.2 |
| | 2 | Aqueous solution of oxalic acid | 3 | 2 | — | 94 | 87 | 0.2 | 0.3 |
| | 3 | Aqueous solution of malonic acid | 4 | 3 | 1 | 98 | 91 | 0.2 | 0.3 |
| | 4 | Aqueous solution of malonic acid | 4 | 2 | — | 97 | 84 | 0.3 | 0.3 |
| | 5 | Aqueous solution of citric acid | 1 | 3 | 1 | 92 | 85 | 0.2 | 0.2 |
| | 6 | Aqueous solution of citric acid | 1 | 2 | — | 91 | 81 | 0.2 | 0.3 |
| | 7 | Aqueous solution of acetic acid | 0.2 | 3 | 1 | 89 | 69 | 0.3 | 0.9 |
| | 8 | Saturated monovalent alcohol solution with carbon atoms of 5 | | 2 | — | 91 | 72 | 0.3 | 0.5 |
| | 9 | Saturated monovalent alcohol solution with carbon atoms of 2 | | 2 | — | 98 | 91 | 0.2 | 0.2 |
| Comparison sample | 1 | — | | — | — | 44 | 42 | 1.6 | 1.5 |
| | 2 | water | | — | — | 48 | 45 | 1.4 | 1.5 |
| | 3 | — | | 3 | 3 | 45 | 42 | 1.5 | 1.6 |
| | 4 | — | | 5 | 3 | 63 | 53 | 1.3 | 1.6 |
| | 5 | water | | 3 | 1 | 82 | 67 | 0.9 | 1.3 |
| | 6 | water | | 2 | — | 71 | 58 | 1.2 | 1.5 |
| | 7 | Aqueous solution of acetic acid | 7 | 3 | 1 | 60 | 53 | 0.8 | 1.2 |
| | 8 | Aqueous solution of acetic acid | 7 | 2 | — | 59 | 52 | 0.8 | 1.3 |
| | 9 | Aqueous solution of sulfuric acid | 0.2 | 2 | — | 67 | 56 | 0.7 | 1.4 |
| | 10 | Aqueous solution of hydrochloric acid | 0.1 | 2 | — | 59 | 53 | 0.9 | 1.5 |
| | 11 | Saturated monovalent alcohol solution with carbon atoms of 10 | | 2 | — | 93 | 59 | 0.3 | 1.2 |

In the samples of the present invention Nos. 1 to 9, as is clear from Table 2, the number of crystal nuclei of zinc phosphate was from $89\times10^4$ to $98\times10^4/cm^2$ in case without the application of the alloying treatment and from $72\times10^4$ to $91\times10^4/cm^2$ even in case with the application of the alloying treatment: these values were on a very high level. As is evident from these values, a zinc phosphate film having dense crystals was formed on the other surface not electrogalvanized of each of the samples of the present invention Nos. 1 to 9. In the comparison samples Nos. 1 to 11, in contrast, the number of crystal nuclei of zinc phosphate was smaller than in the samples of the present invention Nos. 1 to 9. Thus, a zinc phosphate film having dense crystals was not formed on the other surface not electrogalvanized of each of the comparison samples Nos. 1 to 11.

The values of the maximum rust width for the samples of the present invention Nos. 1 to 9 were from 0.2 to 0.3 mm in case without the application of the alloying treatment and from 0.2 to 0.9 mm even in case with the application of the alloying treatment, suggesting a high corrosion resistance after painting of the samples of the present invention Nos. 1 to 9, and painting irregularities and defective paint adherence were not observed on the paint film of any of the samples of the present invention Nos. 1 to 9. For the comparison samples Nos. 1 to 11, in contrast, the values of the maximum rust width were from 0.7 to 1.6 mm except the comparison sample No. 11 in case without the application of the alloying treatment and from 1.2 to 1.6 mm in case with the application of the alloying treatment, suggesting a lower corrosion resistance after painting of the comparison samples Nos. 1 to 11 as compared with the samples of the present invention Nos. 1 to 9, and painting irregularities and defective paint adherence were observed on the paint film of each of the comparison samples Nos. 1 to 11.

Application of the present invention is not limited to the above-mentioned case where the lower surface of a steel strip is electrogalvanized with the use of the horizontal type electrogalvanizing tank, but it is needless to mention that the present invention is also applicable to a case where a one-side surface of a steel strip is electrogalvanized with the use of a vertical type electrogalvanizing tank. When the electrogalvanized surface of the steel strip horizontally travelling after leaving the electrogalvanizing tank is the upper surface, at least one spray nozzle 10, 10' and at least one brush roll 11, 11' may be arranged on the side of the lower surface not electrogalvanized of the travelling steel strip. In this case, at least one backup roll 12, 12' should be arranged on the at least one brush roll 11, 11', so as to be in contact with the upper surface of the travelling steel strip with the steel strip therebetween.

According to the method of the present invention, as described above in detail, it is possible to manufacture a one-side electrogalvanized steel strip in which contamination produced on the other surface not electrogalvanized of the one-side electrogalvanized steel strip is sufficiently eliminated. It is also possible to manufacture a one-side electrogalvanized steel strip in which a phosphate film having dense crystals is formed on the other surface not electrogalvanized of the one-side electrogalvanized steel strip when applying a phosphate treatment to the other surface. It is further possible, when applying painting onto the above-mentioned phosphate film, to manufacture a one-side electrogalvanized steel strip in which high corrosion resistance after painting is imparted to the other surface coated with the paint film, and paint irregularities and defective paint adherence are prevented from occurring on the paint film. The method of the present invention thus provides many industrially useful effects.

What is claimed is:

1. A method for manufacturing a one-side electrogalvanized steel strip, which comprises:

continuously causing a steel strip to travel through an electrogalvanizing bath in an electrogalvanizing tank; arranging at least one electrode plate in said electrogalvanizing bath in said electrogalvanizing tank in parallel to a one-side surface to be electrogalvanized of said travelling steel strip; causing an electric current to flow between said at least one electrode plate and said travelling steel strip through said electrogalvanizing bath to electrogalvanize said one-side surface of said travelling steel strip; arranging at least one spray nozzle toward the other surface not electrogalvanized of said travelling steel strip which has passed through said galvanizing tank over the entire width of said steel strip; ejecting liquid from said at least one spray nozzle onto said other surface not electrogalvanized of said travelling steel strip to wet said other surface of said travelling steel strip; arranging at least one brush roll in close proximity to said at least one spray nozzle on the same side as said at least one spray nozzle relative to said travelling steel strip, said at least one brush roll having a rotation axis parallel to the width direction of said travelling steel strip and extending over the entire width of said steel strip, said at least one brush roll being in contact with said other surface not electrogalvanized of said travelling steel strip; and rotating said at least one brush roll to eliminate contamination caused by the deposition of an electrogalvanizing solution on said other surface not electrogalvanized of said travelling steel strip;

characterized in that:

said liquid ejected from said at least one spray nozzle is any one of an aqueous solution containing a weak acid within the range of from 0.1 to 5.0 wt. % and a saturated monovalent alcohol solution having a number of carbon atoms of up to 5.

2. The method as claimed in claim 1, characterized in that:

said liquid is said aqueous solution of a weak acid selected from the group consisting of oxalic acid, citric acid, malonic acid, and acetic acid.

* * * * *